US007025156B1

(12) United States Patent
Caraway

(10) Patent No.: US 7,025,156 B1
(45) Date of Patent: Apr. 11, 2006

(54) ROTARY DRILL BIT FOR CASTING MILLING AND FORMATION DRILLING

(76) Inventor: Douglas Caraway, 1907 Southern Pines Dr., Kingwood, TX (US) 77339

( * ) Notice: Subject to any disclaimer, the term of this patent is extended or adjusted under 35 U.S.C. 154(b) by 0 days.

(21) Appl. No.: 08/972,781

(22) Filed: Nov. 18, 1997

(51) Int. Cl.
*E21B 29/06* (2006.01)
*E21B 7/04* (2006.01)

(52) U.S. Cl. ..... 175/426; 166/55.1; 175/431

(58) Field of Classification Search ..... 175/426, 175/428, 431, 434, 425, 379, 374, 307, 61, 175/80, 81, 82; 166/298, 55.1
See application file for complete search history.

(56) References Cited

U.S. PATENT DOCUMENTS 4,255,165 A * 3/1981 Dennis et al. ..... 51/309
5,025,874 A * 6/1991 Barr et al. ..... 175/374
5,027,912 A * 7/1991 Juergens ..... 175/434
5,135,061 A * 8/1992 Newton, Jr. ..... 175/428
5,423,387 A * 6/1995 Lynde ..... 175/61
5,531,281 A * 7/1996 Murdock ..... 175/431
5,887,655 A * 3/1999 Haugen et al. ..... 166/298
5,887,668 A * 3/1999 Haugen et al. ..... 175/79
5,979,571 A * 11/1999 Scott et al. ..... 175/61
6,009,962 A * 1/2000 Beaton ..... 175/426
6,073,518 A * 6/2000 Chow et al. ..... 76/108.2

FOREIGN PATENT DOCUMENTS

GB 2086451 * 5/1982 ..... 175/401
WO 9813572 4/1998

* cited by examiner

*Primary Examiner*—Hoang Dang
(74) *Attorney, Agent, or Firm*—Patterson & Sheridan, LLP

(57) ABSTRACT

A rotary drill bit is used both for milling a casing window and drilling a lateral borehole into subterranean earthen materials, without the prior need of having separate drill bits for milling of the casing and for drilling of the borehole. The rotary drill bit is lowered into a casing set within a borehole; and the drill bit is rotated to engage an inner surface of the casing. A first set of cutting elements on the drill bit remove casing material to mill a casing window. The drill bit is then moved through the casing window so that a second set of cutting elements on the drill bit create a lateral wellbore in subterranean earthen material.

6 Claims, 3 Drawing Sheets

ROTARY DRILL BIT FOR CASTING MILLING AND FORMATION DRILLING

BACKGROUND OF THE INVENTION

1. Field of the Invention

The invention relates to rotary drill bits for use in milling a casing window, and for use in drilling subterranean earthen materials.

2. Description of Related Art

After a wellbore has been drilled into subterranean earthen material, a casing is cemented into place to provide protection against pollution of water aquifers. With the advent of improved directional drilling techniques, existing wellbores are being used as starting points from which new, lateral boreholes are drilled. In order to initiate the drilling of a lateral borehole, an opening or window must be cut or milled into the casing. A curved drilling guide or "whipstock" is set in the casing, and a special milling tool is lowered into the casing. The whipstock directs the milling tool against the casing wall, and the rotation of the milling tools creates the casing window. Once the casing window has been created in harder formations, the milling tool must be removed from the casing and a different drill bit used to drill the lateral borehole in the subterranean earthen material.

The use of a milling tool to create the casing window and the use of a different drill bit to drill the lateral borehole causes significant waste of time waiting for the drill string to be removed and then reentered into the casing. With offshore drilling rig day rates being so expensive, there is strong economic incentive to reduce the number of "trips" into and out of the wellbore. Therefore, there is a need for a drill bit that can be used for both milling of the casing window and for drilling the lateral wellbore, without the need for a drill string trip out of and back into the wellbore.

SUMMARY OF THE INVENTION

The present invention has been contemplated to overcome the foregoing deficiencies and meet the above described needs. In particular, the present invention comprises a novel rotary drill bit and its method of use for milling a casing window and for drilling a lateral borehole into subterranean earthen materials. The rotary drill bit has a first set of cutting elements that are specifically adapted for milling casing material, and a separate second set of cutting elements that are specifically adapted for drilling subterranean earthen materials. In use, the rotary drill bit is lowered into a casing set within a borehole; and the drill bit is rotated to engage an inner surface of the casing. The first set of cutting elements on the drill bit remove casing material to mill a casing window. The drill bit is then moved through the casing window so that the second set of cutting elements on the drill bit create a lateral wellbore in subterranean earthen material. The dual use of the rotary drill bit of the present invention eliminates the prior costly need for a drill string trip to change from a milling tool to a separate drill bit.

DETAILED DESCRIPTION OF THE PREFERRED EMBODIMENTS

As briefly described above, the present invention is a rotary drill bit for milling casing material and for drilling subterranean formation material. Generally, the rotary drill bit comprises a bit body having a shank portion for interconnection to a drill string and a plurality of cutting elements extending from the bit body. A first set of the cutting elements are specifically adapted for milling casing material, and a second set of the cutting elements are specifically adapted for drilling subterranean formation material.

As used herein the term "rotary drill bit" means any bit that is rotated to create a borehole in subterranean earthen materials. Examples of such rotary drill bits include rolling cutter rock bits and drag bits, such as core bits, PDC bits, bits having diamond materials impregnated into the body matrix, bits having a lower pilot section and an upper reaming section, bi-centrix bits having sections with differing centers of rotation for drilling boreholes larger than the true diameter of the drill bit, and the like well known to those skilled in the art.

Figure 1:
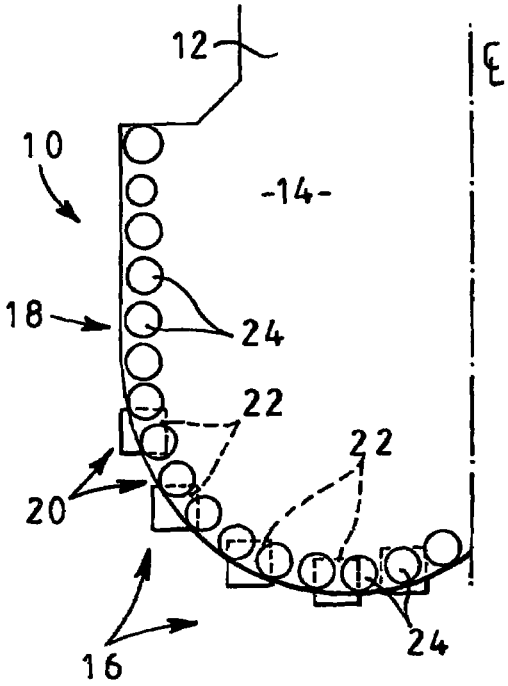
FIG. 1 is a partial elevational view of one preferred embodiment of a drill bit of the present invention.

To better understand the novelty of the drill bit of the present invention and the methods of use thereof, reference is hereafter made to the accompanying drawings. FIG. 1 shows one preferred embodiment of a drag type drill bit 10 of the present invention. The drill bit 10 is comprised of a shank portion 12 for interconnection to a drill string (not shown), as is well known to those skilled in the art, and a bit body 14. The bit body 14 has a face portion 16 and a gage portion 18 with a plurality of cutting elements 20 spaced thereacross.

As used herein, the term "face portion" means the lowermost section of the drill bit that has cutting elements to create the borehole. In relation to rolling cutter drill bits, the face portion of each cone or cutter is the area from the apex of the cone to the last row of cutter teeth that create the borehole. The term "gage portion" means the section of the drill bit that may or may not have cutting elements and extends from the face portion upwardly along the sides of the drill bit. In relation to rolling cutter drill bits, the gage portion of each cone or cutter is the area adjacent the face portion and extending from the largest diameter row of teeth, and includes the heel row, as is well known to those skilled in the art.

As shown in FIG. 1, the cutting elements 20 are divided into at least two sets. A first set 22 of cutting elements are sized, arranged and configured for cutting or milling casing material, such as steel. The cutting elements of the first set 22 are preferably formed from tungsten carbide, cubic boron nitride, or hardened steel, and preferably have an angular or block-like configuration; however, it should be understood that the cutting elements of the first set 22 can have any desired shape and size.

The cutting elements of the second set 24 are sized, arranged and configured for abrading, shearing or crushing subterranean earthen materials, and can be located on the face portion 16, the gage portion 18 or both. The cutting elements of the second set 24 are formed in any desired shape, such as chisel teeth, domed inserts, particles that are impregnated into the bit body, wafers or discs, and the like. Preferably, the cutting elements of the second set 24 are formed from poly crystalline diamond compact (PDC), thermally stable polycrystalline diamond product (TSP), natural diamond, cubic boron nitride, or tungsten carbide.

The cutting elements of the first set 22 and the second set 24 can be attached to the bit body 14 in any known manner, such as a casting, by brazing, welding, soldering, gluing, bolting, and the like.

After the drill bit 10 of the present invention has created the casing window, as will be described more fully below, the same drill bit will be used to create a lateral borehole in subterranean earthen materials. It is intended that all or a substantial portion of the first set 22 of cutting elements be still attached to the drill bit body 14 after creating the casing window, so that these same cutting elements can be used to start the creation of the lateral borehole. However, the first set 22 of cutting elements are formed from a material that is less hard than the second set 24. Therefore, the first set 22 of cutting elements are intended to be quickly removed by or be worn away by rotary drilling of the lateral borehole. The second set 24 of cutting elements can be on the face portion 16, the gage portion 18, or both.

In FIG. 1, all or a portion of the first set 22 of cutting elements have a tip exposure greater than or equal to a tip exposure of the second set 24 of cutting elements. This difference in exposure height is a function of the types of materials used in the different sets of cutting elements 20, as well as the configurations of cutting elements best suited for milling the casing material.

Figure 2:
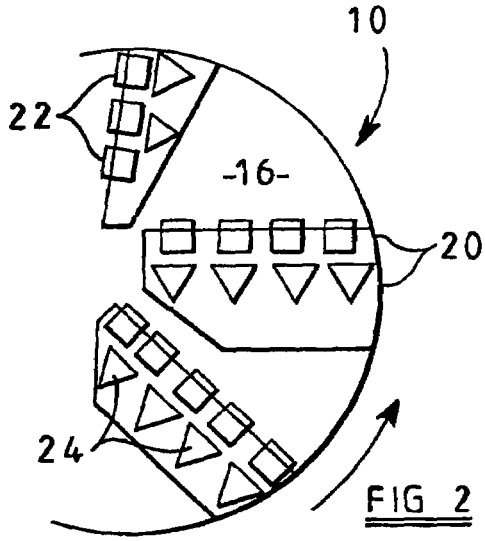
FIG. 2 is a partial plan view of an alternate preferred embodiment of a rotary drill bit of the present invention.

FIG. 2 shows radial rows of cutting elements 20 with the first set 22 trailing the second set 24 in the direction of rotation. However, it should be understood that the first set 22 can proceed the second set 24 in the direction of rotation, or the two sets 22 and 24 can be interposed along the same radial row. In addition, differing subsets of the two sets 22 and 24 of the cutting elements 20 can be arranged in rows or spaced randomly across the face portion 16, the gage portion 18 or both portions of the bit body 14, as is desired.

Figure 3:
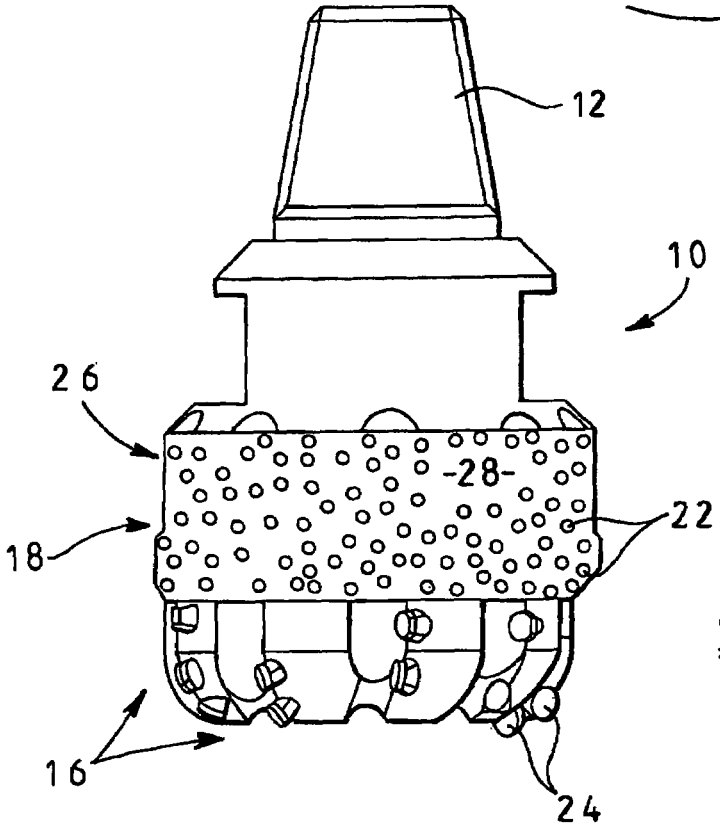
FIG. 3 is an elevational view of an alternate preferred embodiment of a rotary drill bit of the present invention.

An alternate preferred embodiment of the drill bit 10 of the present invention is shown in FIG. 3, and comprises a drill bit body 26 with a specialized milling section 28 attached thereto. The first set 22 of cutting elements are contained on the milling section 28, and the second set 24 of cutting elements are contained on the face portion 16 of the bit body 26. In this embodiment, the first set 22 of cutting elements comprise tungsten carbide or TSP or natural diamond particles embedded into the milling section 28, which is formed from a metallic material, such as brass or bronze, that is bonded, glued, brazed or soldered onto the bit body 26. The milling section 28 can also comprise a ring or cylinder of metallic material, that is bonded or brazed onto the bit body 26. Once the milling section 28 has finished forming the casing window through the relatively soft steel of the casing, it will encounter the very much harder subterranean earthen materials. The milling section 28 will then be abraded away, or preferably will fragment and be quickly removed to expose a plurality of the second set 24 of the cutting elements.

Figure 4:
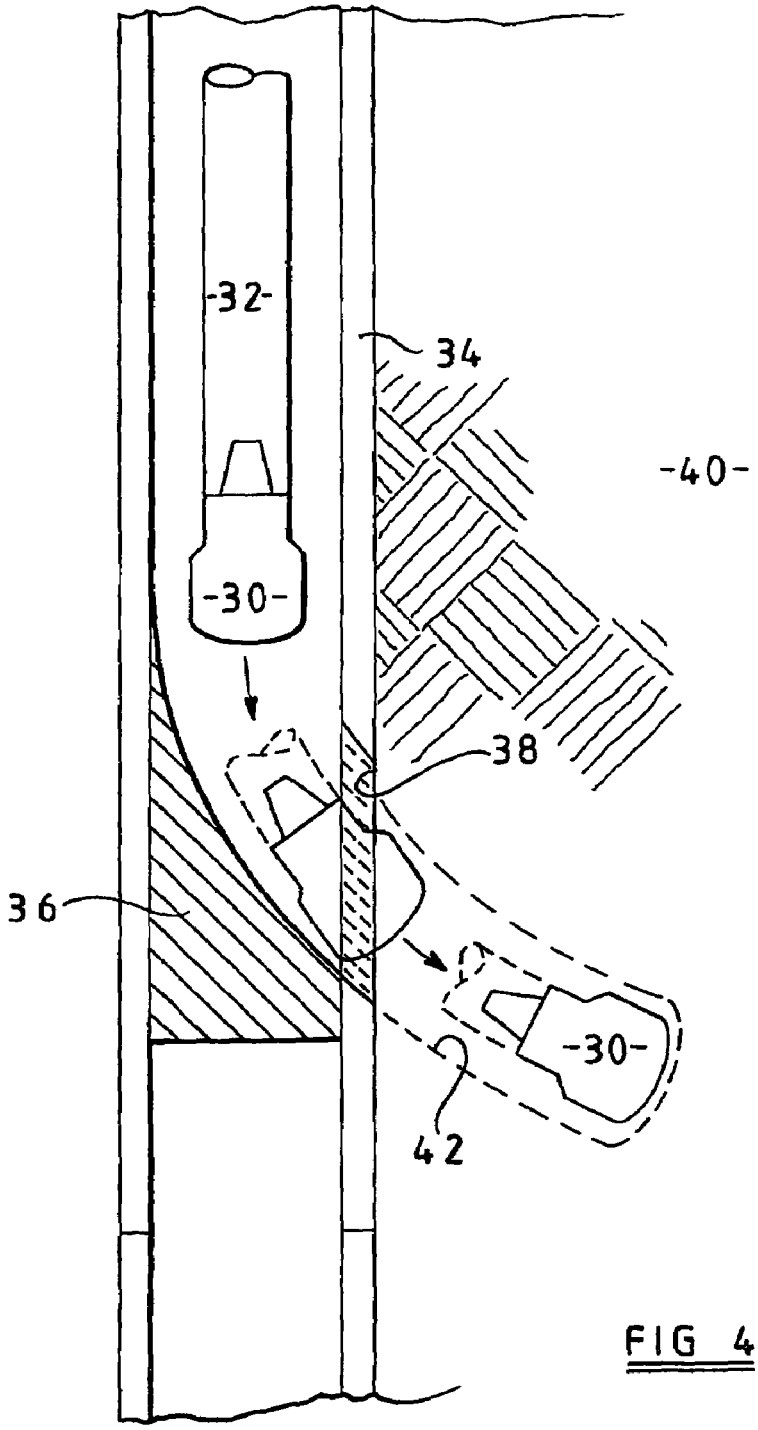
FIG. 4 is an elevational view of a casing set within a wellbore, with one embodiment of a rotary drill bit of the present invention milling a casing window and drilling a lateral borehole.

FIG. 4 illustrates one preferred method of use of a rotary drill bit of the present invention. A drill bit 30 of the present invention is attached to a drill string 32, and is then lowered into a casing 34. Set within the casing 34 is a lateral drilling guide or whipstock 36 that forces the drill bit 30 against an inside surface of the casing 34. When the drill bit 30 is rotated, the first set of cutting elements (not shown) will mill, i.e., remove casing material, an opening or casing window 38. The drill bit 30 and the drill string 32 are then directed through the casing window 38 and out into subterranean earthen material 40. As the drill bit 30 is rotated, the first set of cutting elements are worn down or fall off by encountering the earthen material 40, to thereby expose the second set of cutting elements, which are sized, arranged and adapted to drill such subterranean earthen materials 40. The drill bit 30 then creates a lateral borehole 42 in the earthen material 40 that extends out from the casing 34, as is well known to those skilled in the art.

Figure 5:
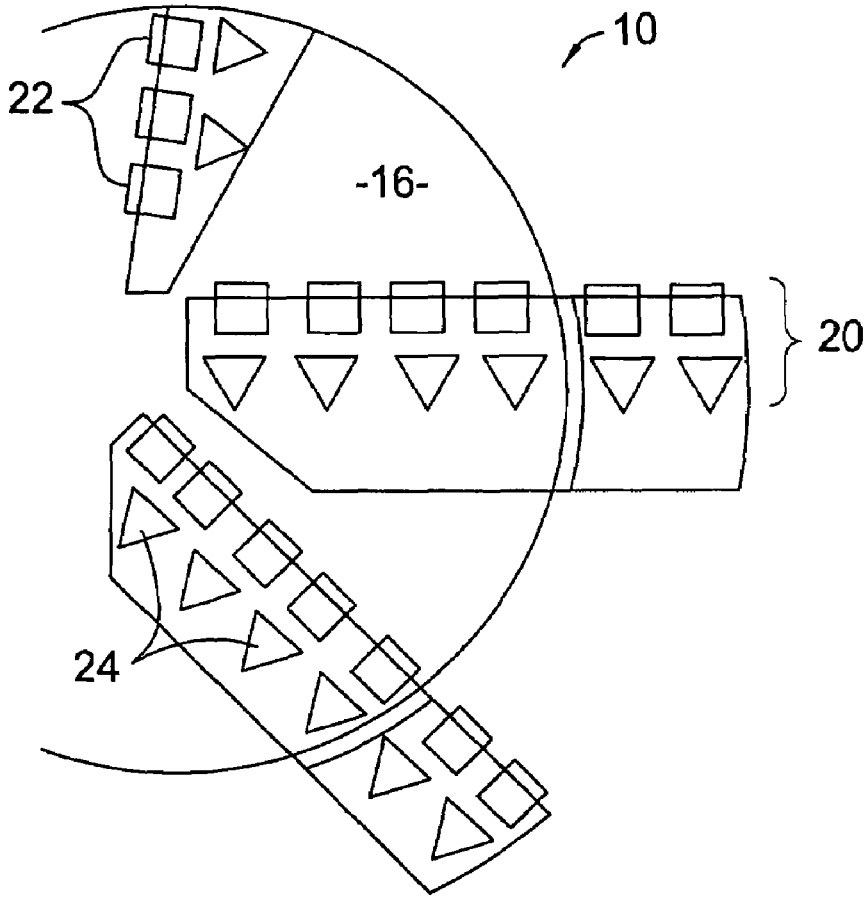
FIG. 5 is a plan view of an embodiment of a rotary drill bit of the present invention.

FIG. 5 shows a bi-centered bit having radial rows of cutting elements 20 with the first set 22 trailing the second set 24 in the direction of rotation. However, it should be understood that the first set 22 can precede the second set 24 in the direction of rotation, or the two sets 22 and 24 of the cutting elements 20 can be arranged in a row or spaced randomly across the bit body, as desired.

As can be understood from the previous discussion, the drill bit of the present invention permits a casing window to be created and a lateral borehole to be drilled, all with the same drill bit. Thereby, the costly prior need for removing the milling tool and rerunning the drill string back into the wellbore to drill the lateral borehole is eliminated.

Whereas the present invention has been described in particular relation to the drawings attached hereto, it should be understood that other and further modifications, apart from those shown or suggested herein, may be made within the scope and spirit of the present invention.

What is claimed is:

1. A rotary drill bit for milling casing material and drilling subterranean formation material, comprising:

a bit body having a plurality of cutting elements extending from the bit body;

a first set of the cutting elements adapted for milling casing material; and a second set of the cutting elements adapted for drilling subterranean formation material, wherein the cutting elements of the first and second sets are substantially interspersed on a surface of the bit body and the first set of cutting elements has a tip exposure substantially equal to a tip exposure of the second set of cutting elements and the cutting elements of the first set have a cross-sectional area different than the cutting elements of the second set.

2. The rotary drill bit of claim 1, wherein the first set is radially displaced outwardly on the bit body relative to the second set.

3. The rotary drill bit of claim 1, wherein the bit body has an axis and the cutting elements of the first and second sets relatively are positioned on substantially the same radius relative to the axis.

4. A rotary drill bit for milling casing material and drilling subterranean formation material, comprising:

a bit body having a shank portion and a matrix portion for interconnection to a drill string, and a plurality of cutting elements extending from the matrix portion;

a first set of the cutting elements adapted for milling casing material; and a second set of the cutting elements adapted for drilling subterranean formation material, wherein the bit is bi-centered.

5. A rotary drill bit for milling casing material and drilling subterranean formation material, comprising:

a bit body for interconnection to a drill string, and a plurality of cutting elements extending from the bit body;

a first set of the cutting elements adapted for milling casing material; and a second set of the cutting elements adapted for drilling subterranean formation material, wherein the bit is bi-centered.

6. A rotary drill bit for milling casing material and drilling subterranean formation material, comprising:

a bit body having a plurality of cutting elements extending from the bit body;

a first set of the cutting elements adapted for milling casing material; and a second set of the cutting elements adapted for drilling subterranean formation material, wherein the cutting elements of the first and second sets are substantially interspersed on a surface of the bit body and the first set of cutting elements has a tip exposure substantially equal to a tip exposure of the second set of cuffing elements and the cutting elements of the first set have a face configuration different than the cutting elements of the second set.

* * * * *

UNITED STATES PATENT AND TRADEMARK OFFICE

CERTIFICATE OF CORRECTION

PATENT NO. : 7,025,156 B1
APPLICATION NO. : 08/972781
DATED : April 11, 2006
INVENTOR(S) : Douglas Caraway It is certified that error appears in the above-identified patent and that said Letters Patent is hereby corrected as shown below:

In column 6, line 6, please delete “cuffing” and insert --cutting--.

Signed and Sealed this

Twenty-sixth Day of September, 2006

JON W. DUDAS
*Director of the United States Patent and Trademark Office*